US010799418B2

(12) United States Patent
Hsu

(10) Patent No.: US 10,799,418 B2
(45) Date of Patent: Oct. 13, 2020

(54) CUSHION STRUCTURE FOR MASSAGER MOVEMENT TOUCH SWITCH

(71) Applicant: U Young Appliance Manufacturing (Xiamen) Co., Ltd., Xiamen, Fujian (CN)

(72) Inventor: Chih-Ming Hsu, Xiamen (CN)

(73) Assignee: U YOUNG APPLIANCE MANUFACTURING (XIAMEN) CO., LTD., Xiamen, Fujian (CN)

( * ) Notice: Subject to any disclaimer, the term of this patent is extended or adjusted under 35 U.S.C. 154(b) by 412 days.

(21) Appl. No.: 15/841,310

(22) Filed: Dec. 14, 2017

(65) Prior Publication Data

US 2018/0177674 A1 Jun. 28, 2018

(30) Foreign Application Priority Data

Dec. 28, 2016 (CN) ..... 2016 2 1456390 U

(51) Int. Cl.
*A61H 7/00* (2006.01)

(52) U.S. Cl.
CPC ..... *A61H 7/004* (2013.01); *A61H 2201/0134* (2013.01); *A61H 2201/0165* (2013.01); *A61H 2201/1623* (2013.01); *A61H 2201/1671* (2013.01); *A61H 2201/5028* (2013.01); *A61H 2201/5071* (2013.01)

(58) Field of Classification Search
CPC ..... A61H 7/004; A61H 2201/0134; A61H 2201/5028; A61H 2201/5071; A61H 2201/1671; A61H 2201/1623; A61H 2201/0165; A61H 2201/018
See application file for complete search history.

(56) References Cited

U.S. PATENT DOCUMENTS 5,184,716 A * 2/1993 Gaines ..... B65G 27/08 198/763
2005/0209538 A1* 9/2005 Lev ..... A61H 15/0078 601/15
2006/0069329 A1* 3/2006 Nan ..... A61H 19/34 601/72
2008/0091127 A1* 4/2008 Nan ..... A61H 15/00 601/60
2010/0179460 A1* 7/2010 Tsai ..... A61H 7/004 601/134

(Continued)

*Primary Examiner* — Samchuan C Yao
*Assistant Examiner* — Savannah L Gabriel
(74) *Attorney, Agent, or Firm* — Leong C. Lei

(57) ABSTRACT

A cushion structure for a massager movement touch switch includes a movement main body and touch switch, where the main body includes a massage head, movement box and fixing plate, where the fixing plate is positioned below the movement box and has guide holes, and the bottom side of the movement box is configured with guide rods, each guide rod movably passed through the corresponding guide hole; springs are configured between the movement box and fixing plate, and the movement box, fixing plate respectively have positioning grooves adapted for the abutment and positioning of the upper, lower sides of each spring. One side of the touch switch is fixed to the fixing plate, and another side thereof is configured with a transmission rod, with an elastic body configured between the upper side of the transmission rod and the bottom side of the movement box, thereby having a cushioning function.

5 Claims, 7 Drawing Sheets

(56) References Cited

U.S. PATENT DOCUMENTS

2013/0102938 A1* 4/2013 Chen ..... A61H 7/004
601/84
2014/0221887 A1* 8/2014 Wu ..... A61H 15/0092
601/112

* cited by examiner

CUSHION STRUCTURE FOR MASSAGER MOVEMENT TOUCH SWITCH

(a) TECHNICAL FIELD OF THE INVENTION

The present invention relates to a massager movement, and more particularly to a cushion structure for a massager movement touch switch.

(b) DESCRIPTION OF THE PRIOR ART

The ways to start massagers are probably divided into manual and automatic ways, where the automatic way is a predetermined part of a human body (e.g. hip) pressing against a massager to cause the massager movement thereof to move to press and switch on a touch switch (e.g. shear pressure transducer) to generate a pressure signal to control the action of the massager when the signal is transmitted to a control circuit.

However, conventional massager movements are configured without a cushion structure, and are usually pressed down not straightly but obliquely to switch on touch switches when human bodies press against massagers, which causes overlarge shear damage to destroy the touch switches or make them sense inaccurately.

From the description mentioned above, it is clearly seen that the touch switch structures of conventional massager movements are not ideal, needing necessary improvements.

SUMMARY OF THE INVENTION

One object of the present invention is to provide a cushion structure for a massager movement touch switch, using the deformability and elasticity of an elastic body and springs and the stable guide function of guide rods and guide holes to transmit the downward force of a movement box to a touch switch elastically and by keeping it in a straight direction.

To achieve the object mentioned above, the present invention proposes a touch switch cushion structure for a massager movement, including: a movement main body, including a massage head, movement box and fixing plate, the massage head configured on the movement box, the fixing plate positioned below the movement box and having a plurality of guide holes, a bottom side of the movement box configured with a plurality of guide rods corresponding to the guide holes, each guide rod movably passed through the corresponding guide hole, a plurality of springs configured between the movement box and fixing plate, each spring put around the corresponding guide rod, and the movement box and fixing plate respectively configured with a plurality of positioning grooves adapted for the abutment and positioning of upper and lower sides of each spring; and a touch switch, one side thereof fixed to the fixing plate and another side thereof configured with a transmission rod, an upper side of the transmission rod configured with a lower platform, elastic body and upper platform in sequence, and the upper platform configured on a bottom side of the movement box, wherein one end of the guide rod is larger, and the guide hole is configured with a stepped portion adapted to be in engagement with the larger part of the guide rod, preventing the guide rod from being separated from the guide hole; wherein a soft cover is put around the guide rod.

Whereby, the downward oblique force of the movement box can be cushioned and scattered through the deformability of the elastic body and springs and the stable guide function of the guide rods and guide holes when the movement box is pressed to drive the transmission rod downward, capable of transmitting the downward force of the movement box elastically and by keeping it in a straight direction, and preventing the massager movement from pressing the touch switch down directly with the oblique pressure to cause overlarge shear damage to destroy the touch switch or making it sense inaccurately so as to overcome the defects of conventional massager movements without a cushion structure.

DETAILED DESCRIPTION OF THE PREFERRED EMBODIMENTS

Figure 1:
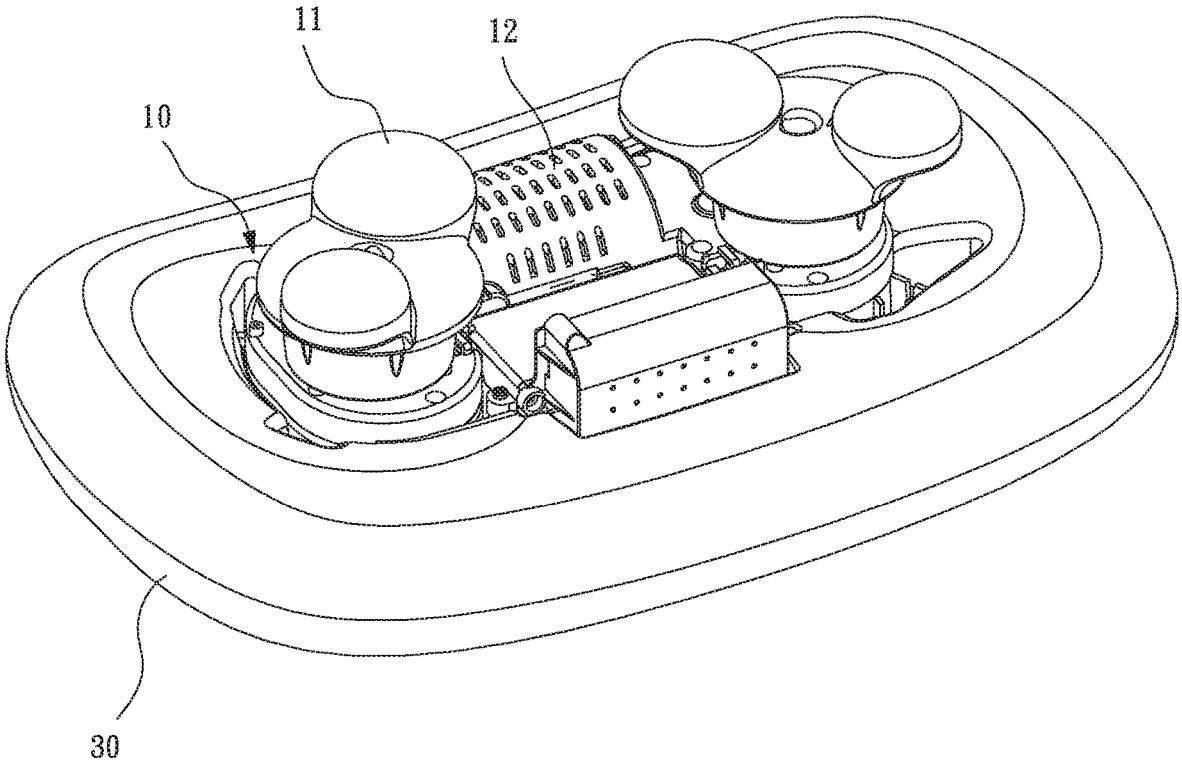
FIG. 1 is a perspective view of the present invention.
Figure 2:
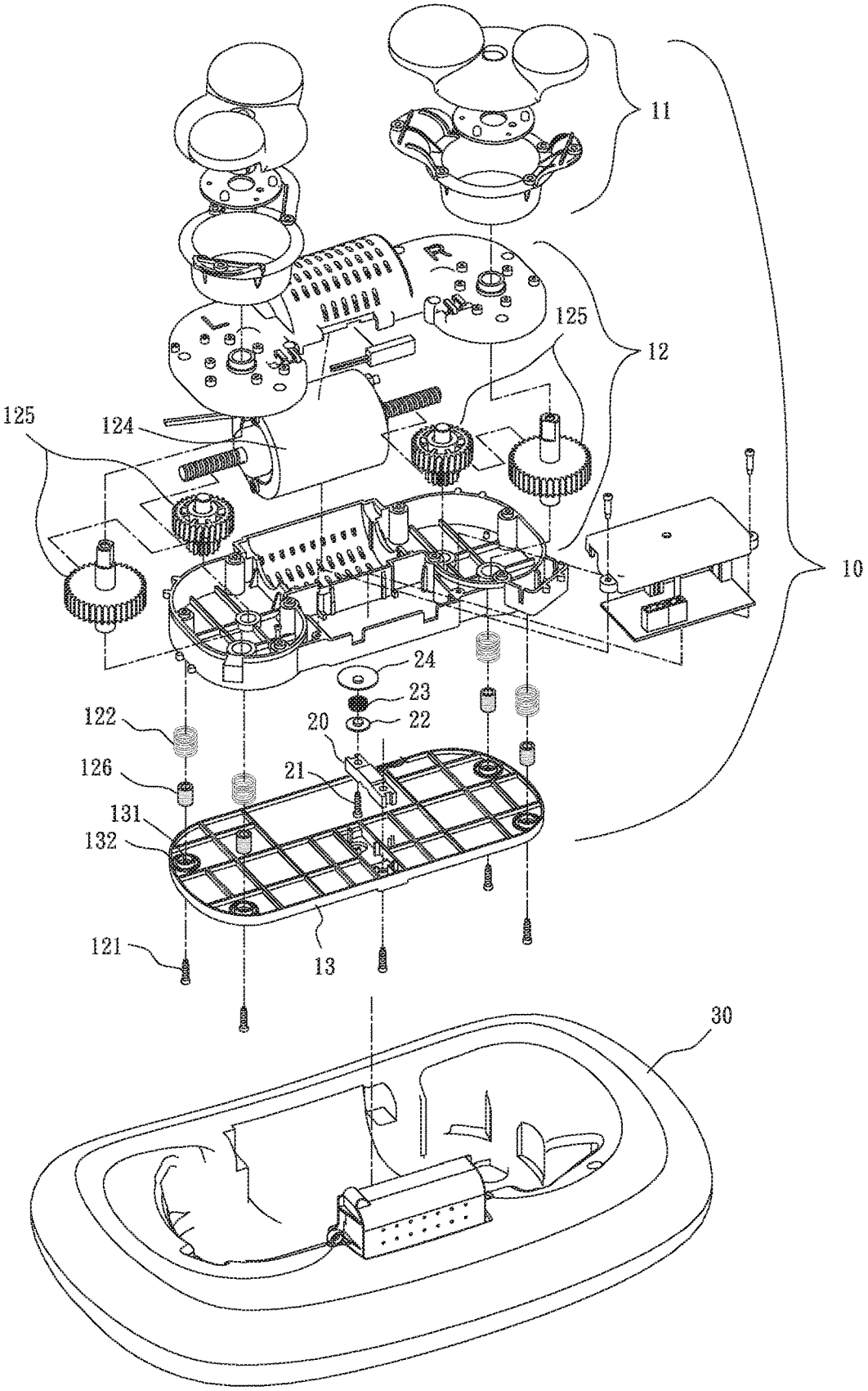
FIG. 2 is an exploded view of the present invention.
Figure 3:
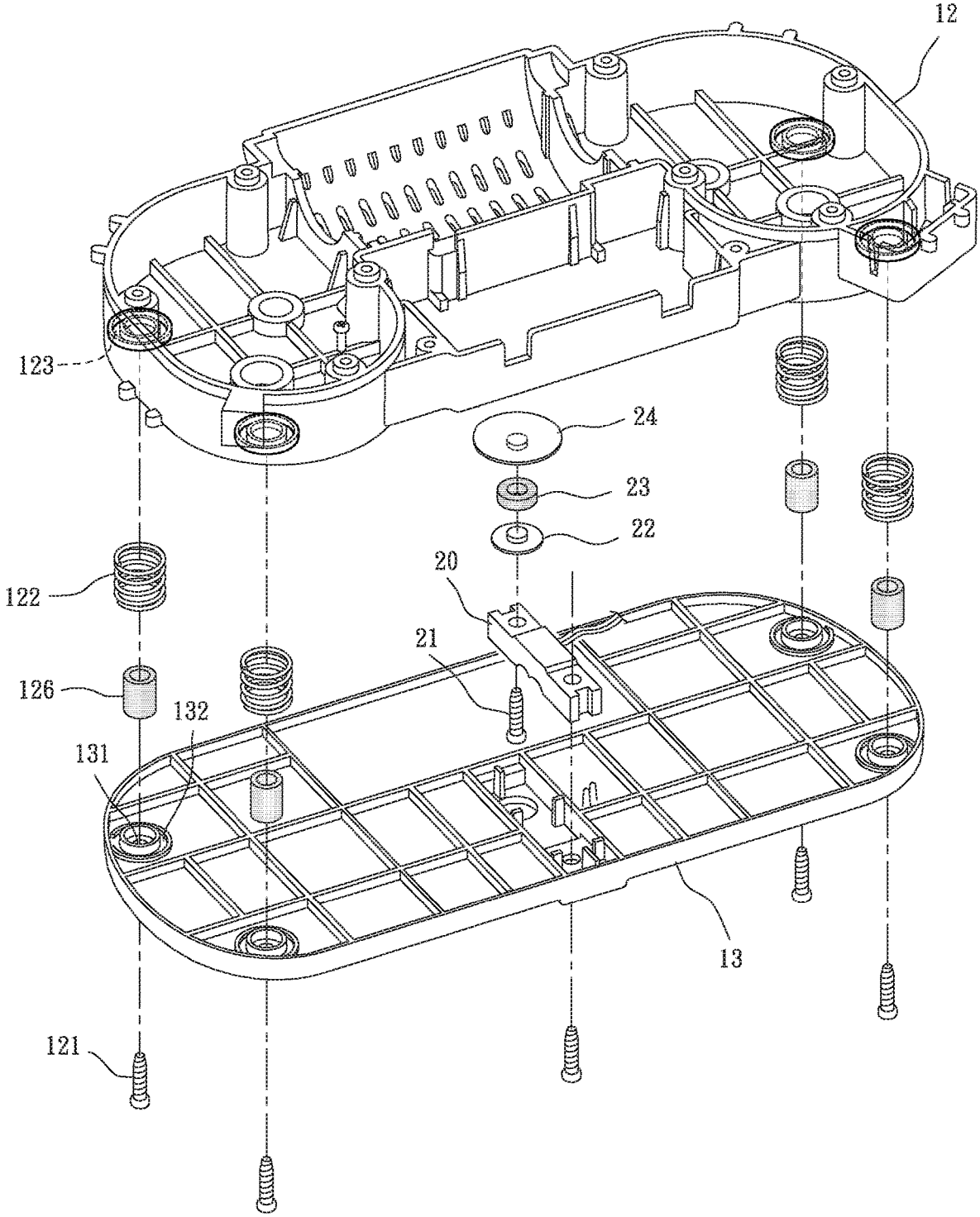
FIG. 3 is an exploded view of an internal structure between a movement box and fixing plate of the present invention.
Figure 4:
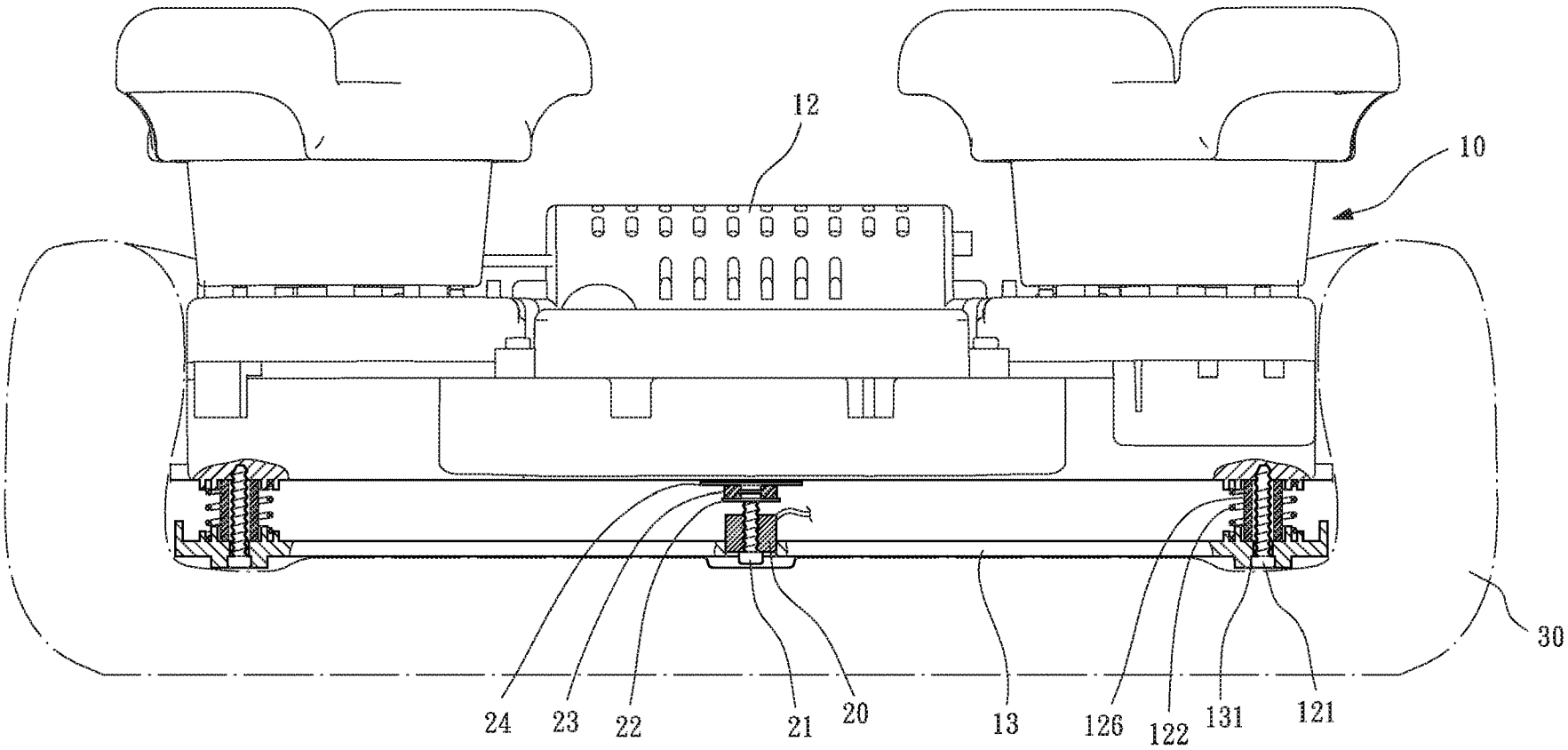
FIG. 4 is a cross-sectional view of the present invention.
Figure 5:
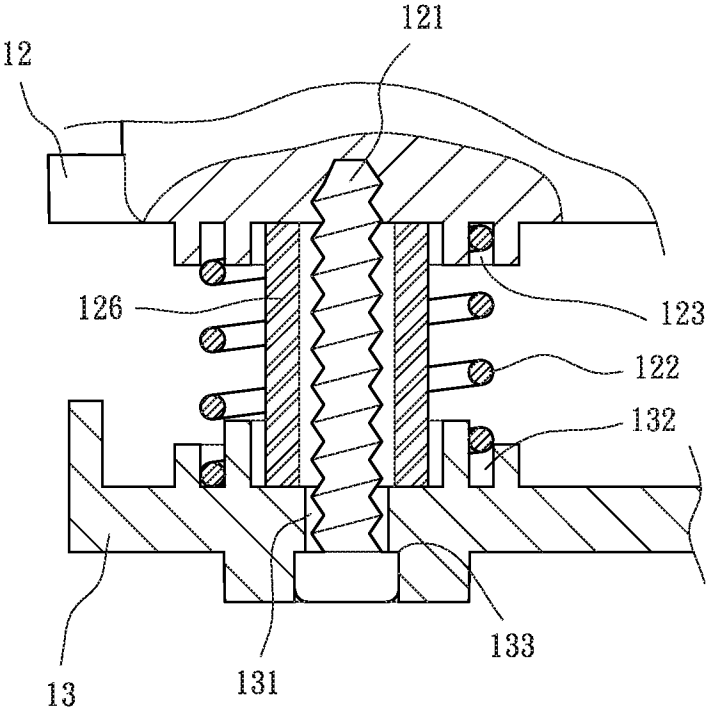
FIG. 5 is an enlarged cross-sectional view of the engagement of a guide rod with a guide hole according to the present invention.
Figure 7:
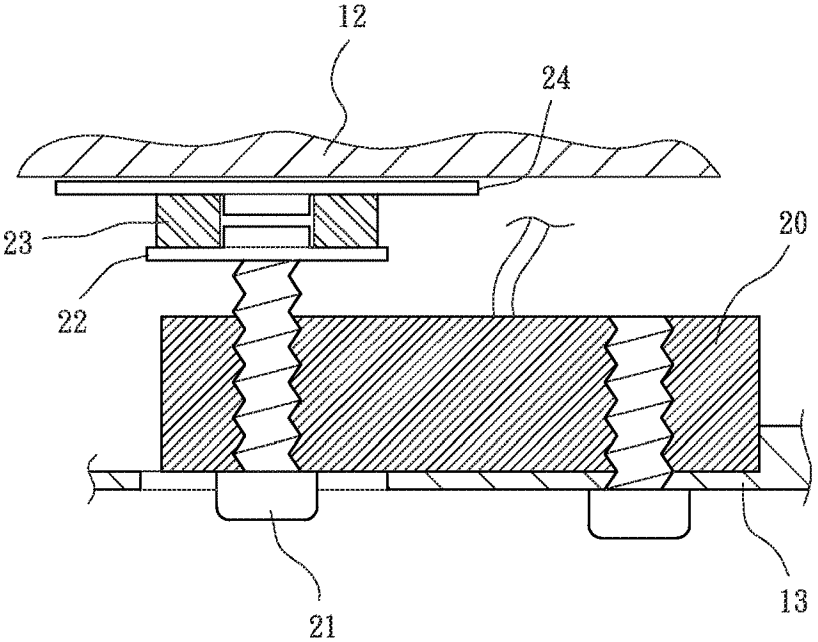
FIG. 7 is a cross-sectional view of the position where a limit switch is configured according to the present invention.

Referring to FIGS. 1 to 5, and 7, a cushion structure for a massager movement touch switch includes a movement main body 10 and touch switch 20.

The movement main body 10 includes at least one massage head 11, movement box 12, and fixing plate 13, where the massage head 11 is configured on the movement box 12, and the fixing plate 13 is positioned below the movement box 12 and provided with a plurality of guide holes 131. The positions of the bottom side of the movement box 12 corresponding to the plurality of guide holes 131 are respectively configured with a guide rod 121 movably passed through the guide hole 131, and the space between the movement box 12 and fixing plate 13 is configured with a plurality of springs 122 each put around the corresponding guide rod 121. Furthermore, the movement box 12 and fixing plate 13 are respectively configured with a plurality of positioning grooves 123 and a plurality of corresponding positioning grooves 132 each pair adapted for the abutment and positioning of the upper and lower sides of the spring 122.

The movement box 12 has a motor 124 and a plurality of gear train 125 adapted to drive the massage head 11 to rotate.

One side of the touch switch 20 is fixed to the fixing plate 3 through screws, and another side thereof is configured with a transmission rod 21, on the upper side of which is configured with a lower platform 22, elastic body 23 and upper platform 24, where the upper platform 24 is configured on the bottom side of the movement box 12.

In a preferred embodiment, one end of the guide rod 121 is larger, and the guide hole 131 is configured with a stepped portion 133 adapted to be in engagement with the larger end of the guide rod 12, thereby preventing the guide rod 121 from being separated from the guide hole 131.

In a preferred embodiment, the guide rod 121 is put around with a soft cover 126 adapted to increase elasticity and cushioning.

In a preferred embodiment, the transmission rod 21 is a screw adapted to adjust the height of the transmission rod 21, thereby allowing the touch pressure of the touch switch 20 to be adjustable.

In a preferred embodiment, the touch switch 20 is a pressure transducer.

In a preferred embodiment, the upper platform 24 is larger than the lower platform 22 in area.

In a preferred embodiment, the movement main body 10 is installed on a supporting stand 30 so as to increase the stability thereof.

With the components and the composition thereof mentioned above, the use, features and functions of the present invention is described as the following.

Figure 6:
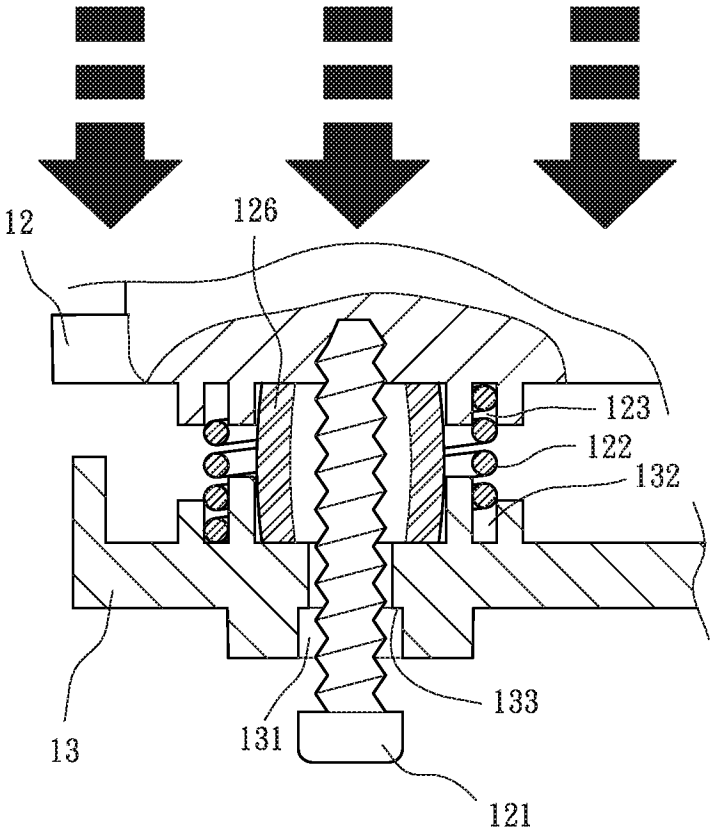
FIG. 6 is an enlarged cross-sectional view of the engagement of the guide rod with the guide hole according to the present invention while subject to downward force.
Figure 8:
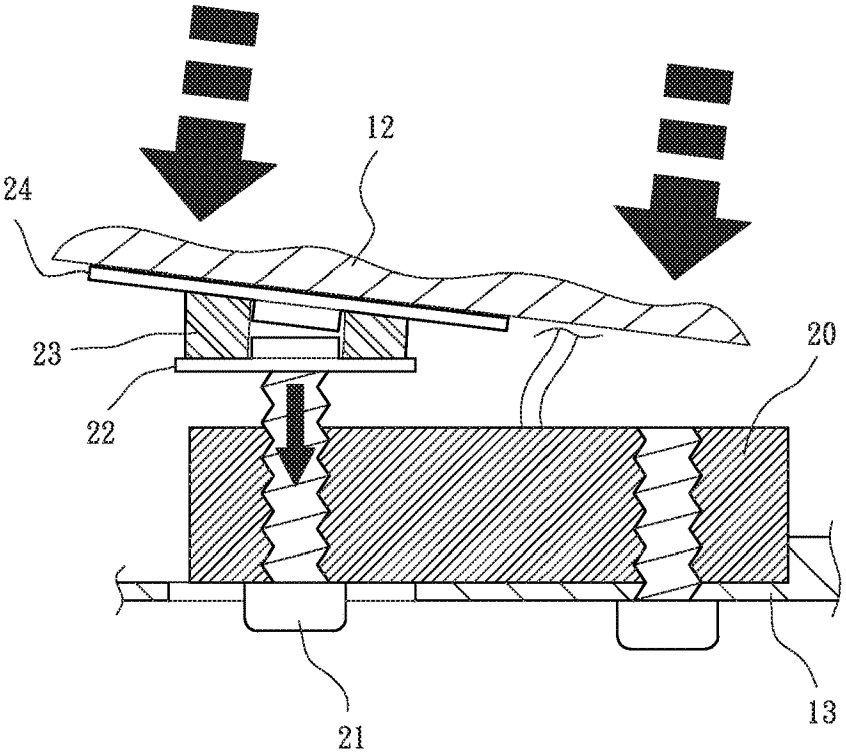
FIG. 8 is a cross-sectional view of the position where a limit switch is configured according to the present invention while subject to downward force.
Figure 9:
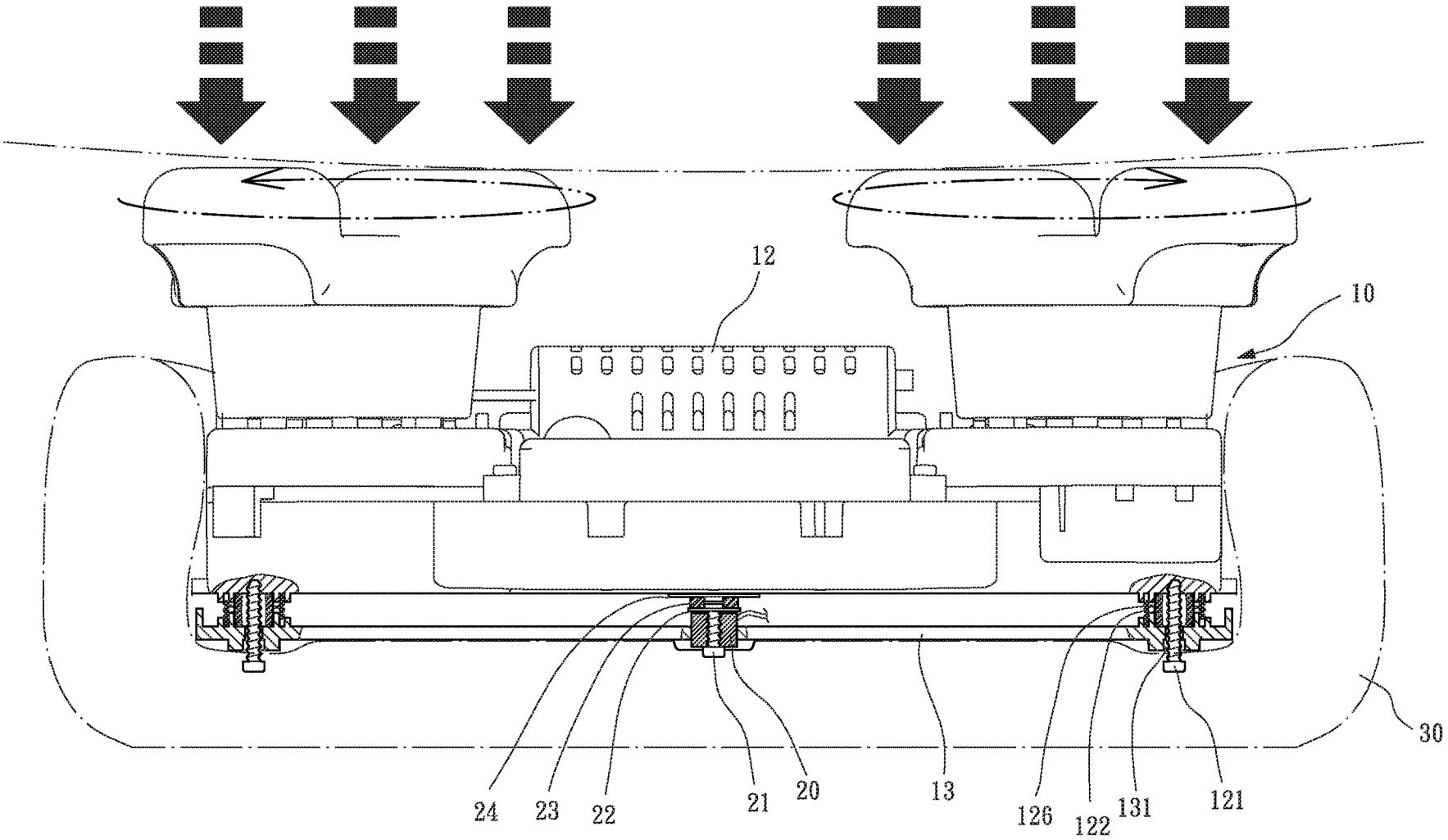
FIG. 9 is a partly cross-sectional view of the present invention upon implementation.

Referring to FIGS. 5 to 9, the movement box 12 is pressed to force the transmission rods 21 downward when the predetermined part of a human body (e.g. hip) is used to press against the movement main body 10, and the deformability and elasticity of the elastic bodies 23 and the springs and the stable guide of the guide rods 121 and guide holes 131 are used to cushion and scatter the downward oblique force of the movement box 12, capable of transmitting the downward force of the movement box 12 elastically and by keeping it in a vertical direction to the touch switch 20, thereby preventing overlarge shear damage from destroying the touch switch 20 or making it sense inaccurately due to the downward oblique force of the massager movement.

I claim:

1. A cushion structure for a massager movement touch switch, comprising:

a movement main body, comprising a massage head, movement box and fixing plate, said massage head configured on said movement box, said fixing plate positioned below said movement box and having a plurality of guide holes, a bottom side of said movement box configured with a plurality of guide rods corresponding to said guide holes, each said guide rod movably passed through said corresponding guide hole, a plurality of springs configured between said movement box and fixing plate, each said spring put around said corresponding guide rod, and said movement box and fixing plate respectively configured with a plurality of positioning grooves adapted for the abutment and positioning of upper and lower sides of each said spring; and a touch switch, one side thereof fixed to said fixing plate and another side thereof configured with a transmission rod, an upper side of said transmission rod configured with a lower platform, elastic body and upper platform in sequence, and said upper platform configured on a bottom side of said movement box;

wherein said guide rods are larger at one end, and said guide holes are configured with a stepped portion adapted to be in engagement with said larger part of said guide rods, preventing said guide rods from being separated from said guide holes;

wherein a soft cover is put around each of said guide rods.

2. The structure according to claim 1, wherein said transmission rod is a screw.

3. The structure according to claim 1, wherein said touch switch is a pressure transducer.

4. The structure according to claim 1, wherein said upper platform is larger than lower platform.

5. The structure according to claim 1, wherein said movement box is installed on a supporting stand.

* * * * *